US008272929B2

(12) United States Patent
Best, Jr.

(10) Patent No.: US 8,272,929 B2
(45) Date of Patent: Sep. 25, 2012

(54) AUTO-ARRANGED COIN STACKER AND DISPENSER

(76) Inventor: James C. Best, Jr., Teaneck, NJ (US)

( * ) Notice: Subject to any disclaimer, the term of this patent is extended or adjusted under 35 U.S.C. 154(b) by 251 days.

(21) Appl. No.: 12/798,635

(22) Filed: Apr. 8, 2010

(65) Prior Publication Data

US 2011/0250829 A1 Oct. 13, 2011

(51) Int. Cl.
*G07D 1/00* (2006.01)

(52) U.S. Cl. ..... 453/39; 194/344; 194/352; 453/43

(58) Field of Classification Search ..... 194/39–341, 194/345, 352; 453/453, 29, 39, 41, 43, 24, 453/44

See application file for complete search history.

(56) References Cited

U.S. PATENT DOCUMENTS 3,235,054 A * 2/1966 Hall ..... 194/231
4,820,237 A 4/1989 Shinozaki et al.
6,793,570 B1 9/2004 Wekstein
6,830,509 B2 12/2004 Perkitny
6,976,619 B2 12/2005 Beachem et al.

* cited by examiner

*Primary Examiner* — Jeffrey Shapiro
(74) *Attorney, Agent, or Firm* — Oktay Enterprises International

(57) ABSTRACT

Auto-Arranged Coin Stacker and Dispenser device that is capable of stacking and dispensing coins automatically in a row and columnar configuration inside chambers formed between a back panel and a front panel between which a space is created to accept coins to drop freely and sequentially from an opening at the top of the device. A spacer having substantially the thickness of the coins is configured to have guide posts wherein the dropping coins are directed automatically to advance downward and arrange themselves first horizontally then vertically in the space provided between the front and back panels. The subsequently falling coins form additional rows vertically above the previous rows in a well-ordered manner by gravity assist and judiciously spaced guides on the sides. The device presents the stacked coins through a translucent frontage to show an immediate accounting of what has been deposited with an aesthetic appearance to the viewer.

18 Claims, 5 Drawing Sheets

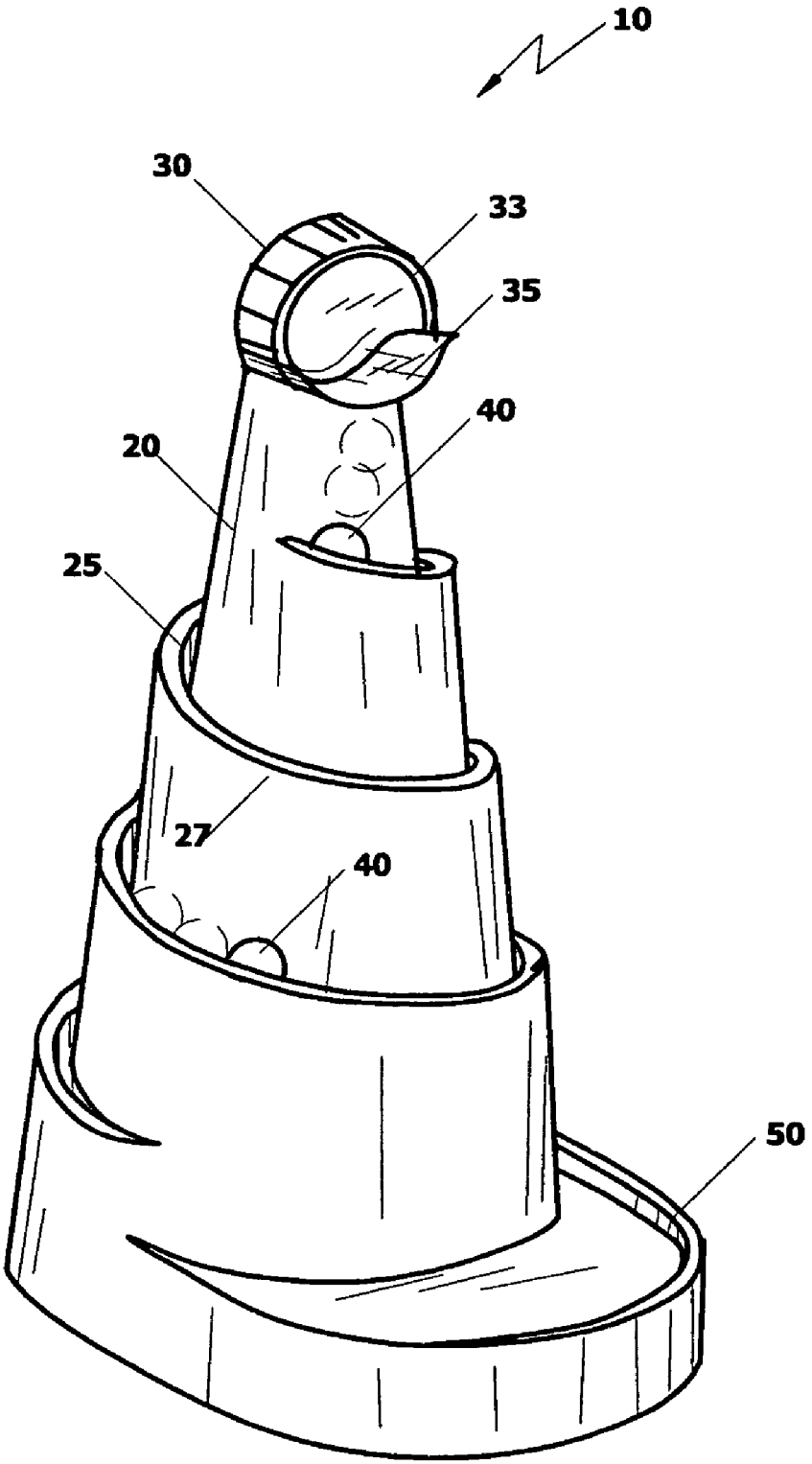
Prior Art- Fig. 1

ABC.1.2$ 100
110
Bt
TWENTY
Hh
150
Bh
115
177
Bw

165
St
162
160
164
163
α
167
Sh
175

131
133
137
135
143
140
180

171
165
Ft
Fc
170
Fh
173
Fw

AUTO-ARRANGED COIN STACKER AND DISPENSER

BACKGROUND

All references cited in this specification, and their references, are incorporated by reference herein where appropriate for teachings of additional or alternative details, features, and/or technical background.

Disclosed is device that accepts coins in a container which can be characterized in general terms as a "coin bank." The presently disclosed container device, however, performs the function not only of a "bank" where coins may be deposited, but also the function of a dispenser where the coins are dispensed in a pre-determined manner from a stack of auto-arranged coins.

Generally, conventional coin banks are known in the art. Jerzy Perkitny of U.S. Pat. No. 6,830,509 provides a coin bank including a housing having a coin receiving area for receiving unsorted coins, a coin sorting area for sorting the unsorted coins and a coin storage area for storing sorted coins. The coin storage area includes a drawer slideably mounted in the housing and a coin tube support movably mounted in the drawer between a first position, when the drawer is fully retracted into the housing and a second position, when the drawer is fully extended from the housing. A plurality of coin tubes is mounted in the coin tube support for holding sorted coins. The plurality of coin tubes is inclined in relation to a vertical axis for receiving sorted coins when the drawer is in a retracted position. A reservoir is located directly above each of the coin tubes for holding at least one additional coin above a stack of coins completely filling the coin tube Susan P. Beacham, et al., of U.S. Pat. No. 6,976,619 discloses a compartmented bank for holding money to be used for saving, spending, donating, investing or other budgetary purposes. The bank is shaped like an animal and comprises a hollow body and four feet. Each compartment communicates with one of the feet so that money deposited into each compartment can be dispensed through an opening in a corresponding foot. The external surface of the body bears indicia indicating the budgetary purpose of the money placed in each compartment Takashi Shinozaki, et al. of U.S. Pat. No. 4,820,237 discloses a coin stacking apparatus including a conveyor for conveying coins edge-wise one at a time and delivering each of the conveyed coins in its horizontal position. A receiver receives the coins from the outlet end of the conveyor in a stacked condition. The receiver includes two endless belts running along the length of the receiver and cooperating with each other to form a coin receiving space there between. Each of the endless belts has a supporter extending therefrom. The supporter includes a surface on which the coins are to be placed. The surface is inclined upwardly and forwardly relative to the direction of the conveyor.

Ted Wekstein of U.S. Pat. No. 6,793,570 teaches a device for depositing and retrieving coins comprising a generally conical-shaped, upstanding body having an exterior tapering to a larger diameter from top to bottom and a header portion at the lop of the body for depositing the objects. A downwardly and outwardly spiraling ramp, below the header portion, extends at least once around the exterior of the body. The ramp cooperates with the exterior of the body on the inside and a lip on the outside to guide the objects as they roll downwardly by gravity. The ramp may include an upwardly extending portion at the lower end of the generally conical-shaped body for launching the objects through the air into the open tray, and/or a staircase portion on the spiraling ramp. A tray adjacent the bottom of the body receives the coins from the ramp.

More specifically, Wekstein describes a device 10, as shown in FIG. 1. The upstanding body portion 20 tapers from a small diameter or width at the top to a larger diameter or width at the bottom. A header portion 30 is disposed at the top of the body portion 20, and functions to receive the coins deposited by the user of the device. Header portion 30 includes a frontward facing vertical face 33 upon which a coin 40 may be placed by the user's hand. Spaced outward from the lower front portion of surface 33 is header wall 35, positioned a sufficient distance such that, when released, coin 40 passes between 33 and wall 35, and out through a slot (not shown) at the lower end of the header portion 30. Traversing around the exterior of body portion 20 in a generally downwardly spiraling configuration is coin ramp 25. According to Wekstein, a coin 40 may roll on its edge along ramp 25, and is guided on one side by the exterior surface of body portion 25 above the ramp, and on the other side by an upstanding ramp guidewall portion 27 on the body portion 25 below the ramp, as shown in FIG. 1. The upper portion of ramp 25 is disposed to receive coin 40 as it drops from header 30 and begins its travel down the ramp. After exiting the ramp, the coins are caught or received in an open coin tray portion 50, which extends outward from the lower part of body portion 20, and is configured for ready access by the user's hand to retrieve coins deposited therein.

It will be evident to those skilled in the art that conventional devices for depositing or dispensing coins are generally configured to be bulbous for housing the deposited coins in a random manner, and convoluted for dispensing them. Also, it is usually difficult to visually keep track of the deposited coins in conventional coin banks. What is needed is an Auto-Arranged Coin Stacker and Dispenser device that is capable of stacking and saving coins automatically in a row and columnar configuration while being aesthetically displayed for ever-present visible accounting of the contents, and enabled to dispense coins sequentially and on demand when a gate is actuated by a latch.

SUMMARY

Aspects disclosed herein include a gravity-assisted auto-arranged coin stacker and dispenser capable of stacking coins automatically in a staggered row and columnar configuration within a container; the container further comprising a back panel, a front panel, and at least a pair of intervening spacer strips separating the back panel from the front panel; the spacer strips further comprising a left spacer strip and an opposing right spacer strip disposed at corresponding right and left edges in between the back panel and front panel thus forming an open space between the back panel and front panel; the left spacer strip having coin deflectors that are formed at an oblique angle with respect to the coin deflectors formed on the opposing right spacer strip; wherein the coin deflectors are spaced apart commensurate with the diameter of the coins to form a staggered row and columnar configuration; the container further apportioned a top portion and a bottom portion, the top portion configured to accept coins, the bottom portion to dispense coins; the space between the back panel and front panel providing an opening in the top portion of the container into which coins can be dropped; the bottom portion comprising further a gate latch that releases a latch bar disposed over a stationary support bar; the stationary bar forming an opening through which the coins can drop; a handle that slides the latch bar over the stationary bar to expose the coins in the top portion above the latch bar to the opening below formed by the stationary bar; and a chute that accepts coins falling from the opening above to roll down to another opening that releases the coins outside the gravity assisted Auto-Arranged Coins Stacker and Dispenser.

a gravity assisted auto-arranged disk stacker and dispenser capable of stacking disks automatically in a staggered row and columnar configuration within a container, the container having a back panel, a front panel, and at least a pair of opposing spacer strips separating the back panel from the front panel at the opposing edges of the back panel and the front panel; the container further comprising a top portion and a bottom portion, the top portion configured to accept disks released into the space formed by the spacer strips disposed between the back panel and the front panel, the bottom portion to dispense disks, wherein the spacer strips, having disk deflectors to direct the disks automatically downward from the top portion to the bottom portion, and wherein the downwardly advancing disks first rest and arrange themselves above a latch bar horizontally and then vertically in a staggered configuration aided by the disk deflectors formed at a relative oblique angle with respect to each other on the opposing space strips disposed at opposing edges of the front and back panels; the latch bar disposed slideably over a stationary support bar having an opening separating the top portion from the bottom portion; the latch bar having a handle at one end and a notch at the other end engageable with a gate latch; the latch bar further having a tongue that is stopped by a shoulder on the stationary support bar when the latch bar is disengaged from the gate latch and pulled sufficiently to expose disks lined up in staggered rows and columns above the latch bar in the top portion; the latch bar performing the function of a gate for dispensing the disks to the bottom portion and to outside of the device via a chute having an exit opening; and wherein the latch bar cooperates with a gate latch for effectuating the gate to release the disks into the chute.

BRIEF DESCRIPTION OF DRAWINGS

FIG. 1 shows a perspective view of a coin deposit and retrieval device, according to prior art.

FIGS. 3*bb* and 3*dd* show a detail of FIGS. 3*b* and 3*d*.

DETAILED DESCRIPTION

In embodiments there is illustrated a device capable of automatically stacking coins (or disk-like objects in general) in row and columnar configuration, and then dispensing them sequentially when so required. The device can be used to encourage saving money in a convenient and useful manner by dropping coins into an attractive casing.

Figures 2A, 2B, 2C, 2D:
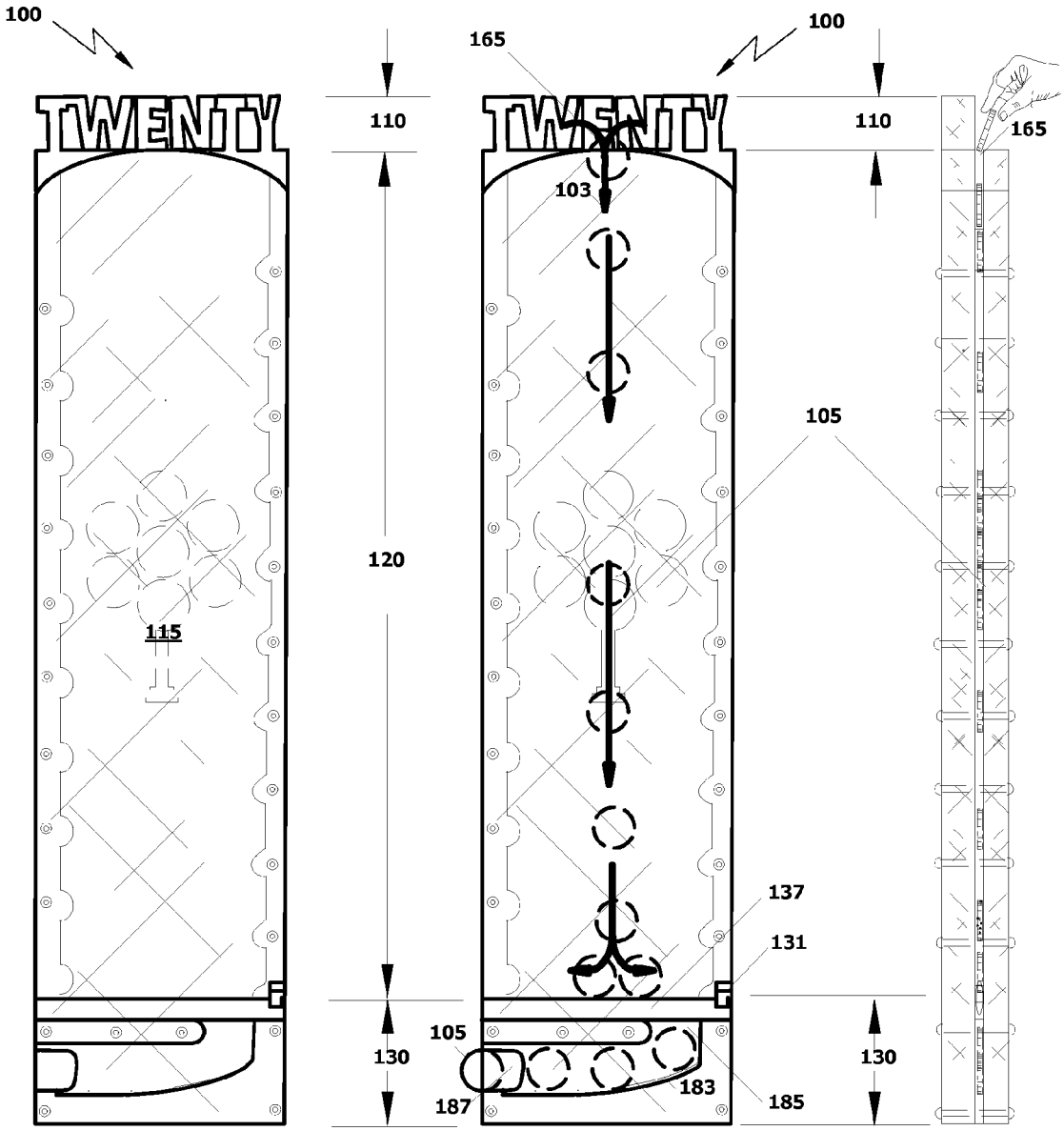
FIGS. 2*a*-2*c* show an embodiment of the presently disclosed Auto-Arranged Coin Stacker and Dispenser device and a trajectory of coins as they enter and travel from the top to the bottom portions of the device.
FIG. 2*d* is a side view of the presently disclosed Auto-Arranged Coin Stacker and Dispenser device showing where coins are dropped into the device.

Referring now to the drawings, the presently disclosed Auto-Arranged Coin Stacker and Dispenser device 100 is shown in FIG. 2*a*. The automatic stacking and dispensing of coins is accomplished with gravity assist and in vertical orientation without the need for any external energy except for the internal potential energy of the coins released from the top of the device as shown in FIGS. 2*a*-4*b*, inclusive. The device comprises a header portion 110, an upper portion 120 and a lower portion 130 that together from a container, or casing to house coins. The header portion 110 provides a name plate for the device. For example, as the device shown in FIG. 2*a* can accommodate 20 rows of four 25-cent quarters in each "dollar row," the inscription "TWENTY" projects that it is a 20$ "Savings Bank." It will be evident that different headers with different alpha-numeric symbols appropriate for the device may be used from a combination of characters partially shown in the exemplary FIG. 2*b*. In addition, any desired graphics, such as the suggested "money tree" 115 may be incorporated into the body of the device, suggesting the use of the device as a portable "Savings Bank." It will be understood by those skilled in the art that the device can be used for other purposes as well as an Auto-Arranged Disk Stacker and Dispenser. In FIG. 2*c*, arrow 103 shows the path of a disk-like object 105 as it is dropped from opening 165 preferably centrally located in the header portion 110 (as shown in FIGS. 2*c*-2*d* and better seen in FIGS. 3*b*-3*bb*) and travels through the upper chamber portion 120 to the lower chamber portion 130, where the disk-like object 105 exits opening 187 when latch 131 is actuated to release bar 137 to create opening 187 for object 105 to slide down a contoured chute 183 and emerge from opening 187 as explained further below. Upper portion 120 serves as a storage chamber for the deposited object coins, and the lower portion 130 as a dispenser chamber.

Figures 3A, 3B, 3C, 3D:
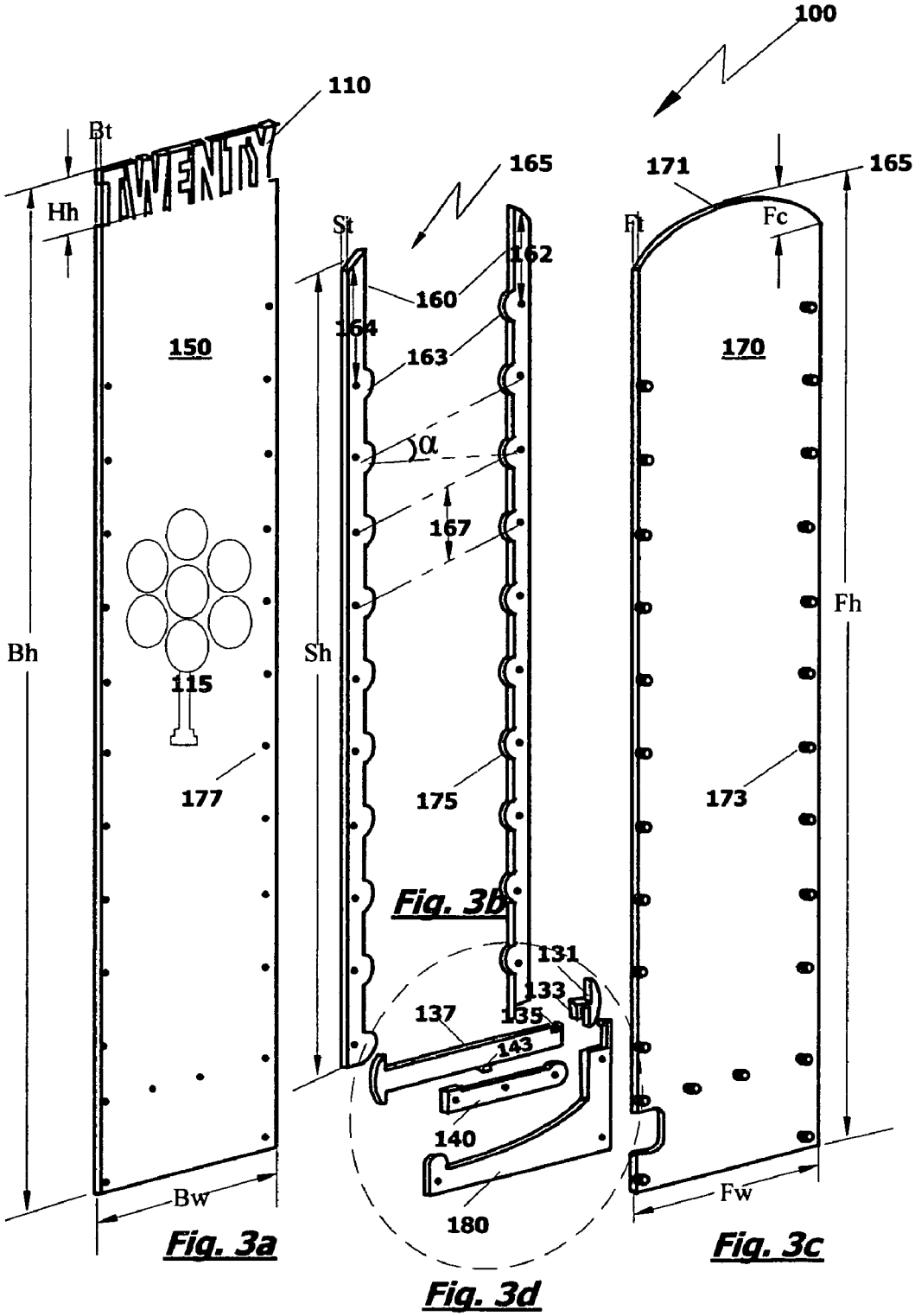
FIGS. 3*a*-3*d* show an exploded view of the disclosed Auto-Arranged Coin Stacker and Dispenser.
Figure 3B:
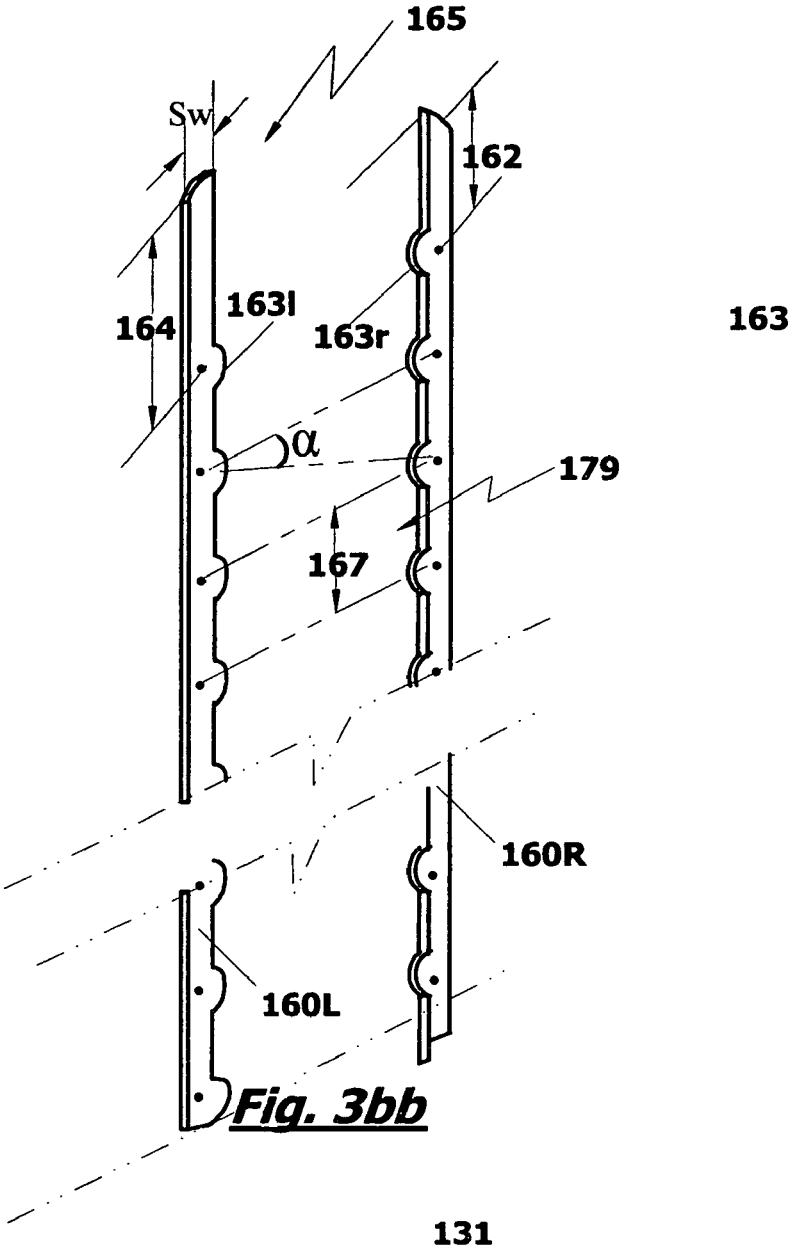
Figure 3D:
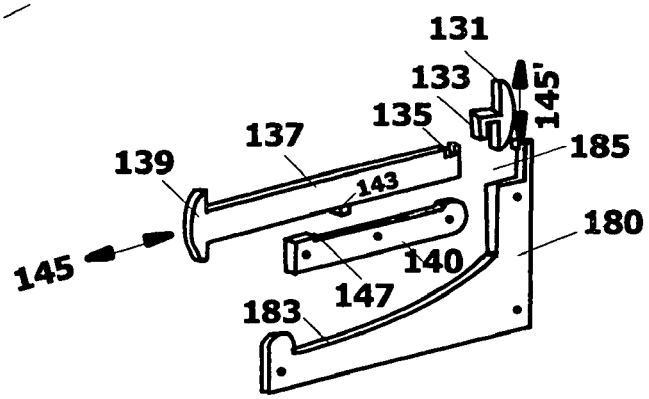
Figures 4A, 4B:
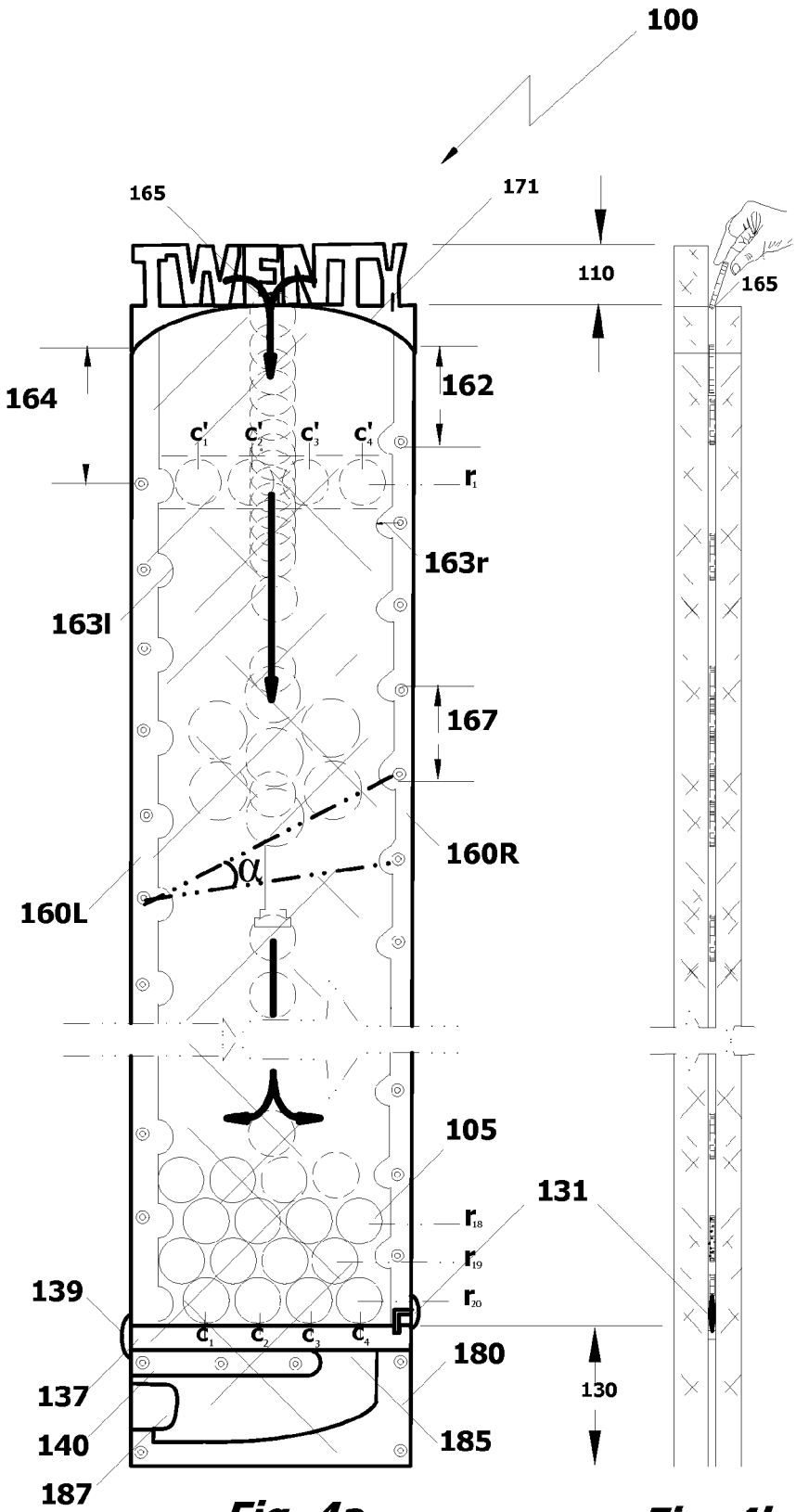
FIG. 4*a* shows the assemblage of coins in rows and columns automatically as they are dropped into the chambers of the disclosed Auto-Arranged Coin Stacker and Dispenser device.
FIG. 4*b* is another side view of the presently disclosed Auto-Arranged Coin Stacker and Dispenser device showing where coins are dropped into the device.

FIGS. 3*a*-3*d* show an exploded view of the disclosed Auto-Arranged Coin Stacker and Dispenser device 100 comprising a back panel 150 and a front panel 170 with a pair of spacers 160 disposed between and along the two vertical edges of the back panel 150 and front panel 170 that together form a flat container or a casing for the coins. Spacers 160, having substantially the thickness of the coins from about 1 mm to about 3 mm, provide guide posts, or deflectors, 163 such that the dropping coins 105 into opening 165 (at the apex of crown 171 as shown in FIG. 3*c* and FIG. 4*a*) are directed automatically to advance downward and arrange themselves first horizontally then vertically in the space provided between the back panel 150 and the front panel 170. At the same time, the judiciously formed guide posts 163 which also serve as deflectors to urge the falling coins to line up in pre-determined rows 179. The first row of falling coins rest on and arrange themselves above a sliding latch bar 137 that forms a gate to a coin dispensing opening 185, better seen in further exploded view in FIG. 3*dd*. When desired, latch bar 137 may be activated with latch 131 in the direction of 145-145' shown in FIG. 3*dd* so as to allow the first coin 105 in the first bottom row above the latch bar 137 to roll into a contoured cavity 183 to be dispensed and released to the outside of the dispenser opening 157, as better seen in 2*c*. The subsequently falling coins from above form additional rows vertically over the previous rows in a well-ordered manner assisted by gravity and guided by deflectors 163 on the sides, as shown in FIG. 4*a*. The presently disclosed Auto-Arranged Coin Stacker and Dispenser device 100 presents the stacked coins through translucent panel 170 for immediate accounting of what has been deposited—with an aesthetic appearance to the viewer.

Referring back to FIGS. 3*a*-3*d*, back panel 150, including the header 110, the front panel 170, the intervening spacer strips 160 and the dispenser 130 component parts comprising the gate handle, or latch 131, the sliding latch bar 137 and base bar 140, and the dispenser guide 180, they all are made out of translucent plastic, although it will be understood that other materials may also be used. All parts are assembled and secured together by fastening them with screws 173 into threaded openings 175 and 177 as shown in FIGS. 3*a*-3*d*, although other fasteners may also be used as required.

In one aspect of the present disclosure, the over-all and various other dimensions of the Auto-Arranged Coin Stacker and Dispenser device 100 are derived from the size of the disk or the type of coin denomination used. For illustrative purposes, a 25 cent, or a quarter will be used for a TWENTY$ "Coin Bank." Accordingly, the 20$ Auto-Arranged Coin Stacker and Dispenser "Coin Bank" 100 will accommodate eighty (80) quarters. Choosing four (4) quarters to a row, the "Coin Bank" shown in FIG. 4*a* has 20 rows, ($r_1 \ldots r_{20}$) with 1$ per row. Accordingly, the center-to-center spacing between deflectors 163 shown in FIG. 4*a* ranges from about 40 mm to about 42 mm. Furthermore, the radius of each deflector is from about 10 mm to about 12 mm.

It will be appreciated that it is the "staggered" (diagonal) configuration of the coin deflectors 163 at an "oblique" angle $\alpha$ formed between consecutive deflectors 163*l* and 163*r* on opposing spacer strips 160L and 160R, respectively, as shown in FIG. 4*a* that makes it possible to automatically arrange the coins "staggerdly" (that is, diagonally) in rows ($r_1 \ldots r_{20}$) and columns ($c_1 \ldots c_4$) shown in FIG. 4*a* for a TWENTY$ Bank having 20 1$ rows, each row holding 25 cents in 4 columns. In other words, the coin deflectors 163*l* on one spacer strip, say spacer strip 160L shown in the same FIG. 4*a*, are formed at an oblique angle $\alpha$ with respect to the coin deflectors 163*r* formed on the opposing spacer strip 160R commensurate with the diameter of the staggered coins.

In another aspect, in order to provide automatic stacking of the coins first horizontally and then vertically, the opposing deflectors 163 are staggered with respect to each other by an oblique angle $\alpha$ in a range from about 8 degrees to about 10 degrees, as better seen in FIG. 3*bb*. The stagger is established by forming the first deflector on the right 163*r*—as viewed by the reader—at a distance 162 from the top of the spacer strips 160 in the range of about 30 mm to about 50 mm and the first deflector on the left 1631 at a distance 164 in the range of about 50 mm to about 70 mm as can be seen in both FIG. 3*bb* and FIG. 4*a*. It will be noted that the coin deflectors are spaced apart a distance of 167 from each other commensurate with the diameter of the coins to form a workable staggered row and columnar configuration; which in the case of a 25 mm diameter 25 cent quarter, 167 ranges from about 37 mm to about 39 mm since the coin deflectors have a diameter ranging from about 10 mm to about 12 mm. It will be understood that these dimensions and the ones that follow below will vary depending upon the size of the coins that the Auto-Arranged Coin Stacker and Dispenser is designed to accommodate.

For illustrative purposes, the height, h, width, w, and thickness, t, of the Back (B) panel 150, Spacer (S) strips 160 and the front (F) panel 170 are designated as Bh, Bw, Bt; Sh, Sw, St; Bh, Bw, Bt, respectively, in FIGS. 3*a*-3*d* and to continue with the illustrative TWENTY$ Bank using quarter size coins;

for the Back Panel 150, Bh ranges from about 590 mm to about 580 mm;

Bw ranges from about 130 mm to about 140 mm;

Bt ranges from about 25.4 mm to about 1.5 mm; and for the Spacer Str. 160, Sh ranges from about 460 mm to about 470 mm;

Sw ranges from about 17 mm to about 30 mm;

St ranges from about 1 mm to about 5 mm; and for the Front Panel 170, Fh ranges from about 550 mm to about 560 mm;

Fw ranges from about 130 mm to about 140 mm;

Ft ranges from about 25.4 mm to about 1.5 mm;

It will also be noted that the crown rise, Fc, for crown 171 of the front panel 170 shown in FIG. 3*c* ranges from about 25.4 mm to about 27.4 This dimension enters into the stagger dimensions of 162 and 164 in FIG. 4*a*. Similarly, the header height of Hh in FIG. 3 may vary from about 30 mm to 40 mm.

The latching mechanism used for gate in FIG. 3*dd* comprises latch 131, a tongue 133 that engages notch 135 such that when latch 131 is lifted in the up or down directions 145', respectively, latch bar 137 is actuated to control opening 185 through which a coin 105 can pass and slide down the contoured chute or passageway 183 of the dispenser wall 180 out the gate door 187 shown in FIG. 2*c*. Handle 139 serves the function of providing a means for pulling the sliding latch bar 137 laterally in the directions 145 and disengaging the bar 137 from latch 131, which in turn opens up gate 185 to activate the coins/disk to slide down the chute 183. It will be noted that latch bar 137 slides sufficiently for coins 105 to pass through gate 185 until tongue 143 shown in FIG. 3*dd* is stopped by shoulder 147 of support bar 140. In this aspect, latch bar 137 is prevented from leaving the lower chamber 130 completely so as to not to completely empty out the upper chamber 120 shown in FIG. 2*c* all at once. Handle 139 also serves as a stop that closes flush with the left spacer strip 160L and support bar 140. Sliding latch bar 137 also serves as a stop engaging dispenser wall 180 and right spacer strip 160R. FIG. 4*a* shows the assemblage of coins in rows and columns automatically as they are dropped into the chambers of the disclosed Auto-Arranged Coin Stacker and Dispenser device.

In operation, gate latch 131 shown in FIG. 4*a* is lifted upward to disengage from notch 135 in latch bar 137 disposed over stationary support bar 140 and latch bar 137 is then slidingly pulled with handle 139 to expose disks 105 above to opening 185 thereby allowing disks 105 to roll down the contoured chute 183 to exit door 187 shown in FIG. 4*a*. It will be noted that latch bar 137 is prevented from leaving the lower chamber 130 completely so as to not to completely empty out the upper chamber 120 shown in FIG. 2*c* all at once. This is accomplished by providing tongue 143 shown in FIG. 3*dd* which is stopped by shoulder 147 of support bar 140. In this manner, desired number of disks may be released from the disclosed gravity assisted "Auto-Arranged Coin Stacker and Dispenser."

Though these numerous details of the disclosed method are set forth above, such as dimensional parameters, to provide an understanding of the present invention, it will be obvious, however, to those skilled in the art that these specific details need not be employed to practice the present invention. At the same time, it will be evident that the same form factors may be employed in other similar devices that are too many to cite. For example, an Auto-Arranged Stacker and Dispenser may be constructed for other round objects such as ping-pong balls, tennis balls and other articles that can be conveniently collected in a throw-in receptacle that automatically arranges the articles vertically and horizontally in rows for retrieval on demand. Furthermore, although the present disclosure employs gravity assist in auto-arranging the articles in row and columnar configuration, mechanical instruments such as springs may also be used to impart energy to the articles to achieve similar results.

That is, while the invention has been particularly shown and described with reference to particular embodiment(s), it will be appreciated that variations of the above-disclosed embodiment(s) and other features and functions, or alternative thereof may be desirably combined into many other different systems or applications. Also that various presently unforeseen or unanticipated alternative, modifications, variations or improvements therein may be subsequently made by those skilled in the art which are also intended to be encompassed by the following claims

What is claimed is:

1. A device comprising a gravity-assisted auto-arranged coin stacker and dispenser capable of stacking coins automatically in a staggered row and columnar configuration within a container;

the container further comprising a back panel, a front panel, and at least a pair of intervening spacer strips separating the back panel from the front panel;

the spacer strips further comprising a left spacer strip and an opposing right spacer strip disposed at corresponding right and left edges in between the back panel and front panel thus forming an open space between the back panel and front panel;

the left spacer strip having coin deflectors that are formed at an oblique angle with respect to the coin deflectors formed on the opposing right spacer strip;

wherein the coin deflectors are spaced apart commensurate with the diameter of the coins to form a staggered row and columnar configuration;

the container further apportioned a top portion and a bottom portion, the top portion configured to accept coins, the bottom portion to dispense coins;

the space between the back panel and front panel providing an opening in the top portion of the container into which coins can be dropped;

the bottom portion comprising further a gate latch that releases a latch bar disposed over a stationary support bar;

the stationary bar forming an opening through which the coins can drop;

a handle that slides the latch bar over the stationary bar to expose the coins in the top portion above the latch bar to the opening below formed by the stationary bar; and a chute that accepts coins falling from the opening above to roll down to another opening that releases the coins outside the gravity assisted auto-arranged coin stacker and dispenser.

2. The device according to claim 1, wherein the intervening spacer strips separating the back panel from the front panel have a thickness ranging from about 1 mm to about 5 mm.

3. The device according to claim 1, wherein the coin deflectors on opposing spacer strips are formed at a relative oblique angle from about 8° to about 10°.

4. The device according to claim 1, wherein the height of the back panel ranges from about 580 mm to about 590 mm.

5. The device according to claim 1, wherein the width of the back panel ranges from about 130 mm to about 140 mm.

6. The device according to claim 1, wherein the thickness of the back panel ranges from about 25.4 mm to about 1.5 mm.

7. The device according to claim 1, wherein the height of the spacer strips range from about 460 mm to about 470 mm.

8. The device according to claim 1, wherein the width of the spacer strips range from about 17 mm to about 30 mm.

9. The device according to claim 1, wherein the height of the front panel ranges from about 550 mm to about 560 mm.

10. The device according to claim 1, wherein the width of the front panel ranges from about 130 mm to about 140 mm.

11. The device according to claim 1, wherein the thickness of the front panel ranges from about 25.4 mm to about 1.5 mm.

12. The device according to claim 1, wherein the coin deflectors form semi-circular shapes having a radius from about 10 mm to about 13 mm.

13. The device according to claim 1, wherein the deflectors are formed along the length of the intervening spacer strips at a center to center distance ranging from about 30 mm to about 50 mm.

14. The device according to claim 1, wherein the latch bar is effectuated by the gate latch to dispense the coins from the device.

15. A device comprising a gravity assisted auto-arranged disk stacker and dispenser capable of stacking disks automatically in a staggered row and columnar configuration within a container, the container having a back panel, a front panel, and at least a pair of opposing spacer strips separating the back panel from the front panel at the opposing edges of the back panel and the front panel;

the container further comprising a top portion and a bottom portion, the top portion configured to accept disks released into the space formed by the spacer strips disposed between the back panel and the front panel, the bottom portion to dispense disks, wherein the spacer strips, having disk deflectors to direct the disks automatically downward from the top portion to the bottom portion, and wherein the downwardly advancing disks first rest and arrange themselves above a latch bar horizontally and then vertically in a staggered configuration aided by the disk deflectors formed at a relative oblique angle with respect to each other on the opposing space strips disposed at opposing edges of the front and back panels;

the latch bar disposed slideably over a stationary support bar having an opening separating the top portion from the bottom portion;

the latch bar having a handle at one end and a notch at the other end engageable with a gate latch;

the latch bar further having a tongue that is stopped by a shoulder on the stationary support bar when the latch bar is disengaged from the gate latch and pulled sufficiently to expose disks lined up in staggered rows and columns above the latch bar in the top portion;

the latch bar performing the function of a gate for dispensing the disks to the bottom portion and to outside of the device via a chute having an exit opening; and wherein the latch bar cooperates with a gate latch for effectuating the gate to release the disks into the chute.

16. The device according to claim 15, wherein the disk deflectors are spaced apart commensurate with the diameter of the disks to form a staggered row and columnar configuration.

17. The device according to claim 15, wherein the relative oblique angle between the disk deflectors on opposing spacer strips range from about 20° to about 30°.

18. The device according to claim 15, wherein the device comprises a translucent frontage showing an immediate accounting of deposited coins with an aesthetic appearance to the viewer.

* * * * *